US005558147A

United States Patent [19]

Nofziger

[11] Patent Number: 5,558,147

[45] Date of Patent: Sep. 24, 1996

[54] DOOR COUNTERWEIGHT ASSEMBLY

[75] Inventor: Edward L. Nofziger, Wauseon, Ohio

[73] Assignee: Nofziger Doors International, Inc., Archbold, Ohio

[21] Appl. No.: 488,632

[22] Filed: Jun. 8, 1995

[51] Int. Cl.[6] ..... E05F 11/04

[52] U.S. Cl. ..... 160/190; 160/320; 16/194; 242/388.1

[58] Field of Search ..... 160/190, 201, 160/189, 133, 320, 321; 16/194, 209, 212, 218, DIG. 8, DIG.12; 242/388.1, 388.5

[56] References Cited

U.S. PATENT DOCUMENTS 485,664 11/1892 Schubert ..... 242/388.1
565,612 8/1896 Fernald ..... 16/209
1,077,924 11/1913 Atlas ..... 16/218
1,940,583 12/1933 Demeulenaere ..... 160/320
3,981,343 9/1976 DeVito ..... 160/190 X
4,335,776 6/1982 Debs ..... 16/218 X
5,259,433 11/1993 Cloutier ..... 160/190

*Primary Examiner*—Blair Johnson
*Attorney, Agent, or Firm*—Emch, Schaffer, Schaub & Porcello

[57] ABSTRACT

A door counterweight assembly for positioning on a door shaft is disclosed. A pair of spaced disks are mounted on the door shaft and a tape drive member extends between the disks parallel to the door shaft. A continuous flexible tape has a portion surrounding the shaft. The flexible tape is positioned between the shaft and the drive member. The tape includes another portion which supports a counterweight. Rotation of the shaft folds the tape in a generally circular configuration to increase the counterweight torque applied to the shaft.

10 Claims, 5 Drawing Sheets

DOOR COUNTERWEIGHT ASSEMBLY

BACKGROUND OF THE INVENTION

This invention relates to an improved counterweight system for use with overhead doors. Counterweight systems for overhead doors are known in the art.

U.S. Pat. No. 5,103,890 discloses a system in which a cable is attached to a counterweight at one end. The other end the cable is mounted around a drum. The drum is carried by the shaft of the door. The drum has a progressive radius. When the cable is wrapped on the drum the conical shaped surface of the drum moves the cable outwardly during rotation thereby changing the counterweight torque. The purpose of changing the torque is to apply a greater force during opening of the door, when the effective weight of the door is the greatest. Conversely, when the effective weight is reduced, for example when the door is in its horizontal position, the cable is wrapped on the smaller diameter portion of the drum and the effective torque is reduced.

SUMMARY OF THE INVENTION

The present invention provides a door counterweight assembly which does not rely upon a drum having a cone surface to vary the effective torque on a door shaft. Rather, the present invention uses a continuous, generally flat tape which is rolled on the door shaft. The continuous tape is looped on itself to double the thickness of the rolled tape and thereby quickly change the effective torque being applied to the shaft by the counterweight.

The door counterweight assembly, according to the present invention, includes a pair of spaced disks having aligned openings which receive a door shaft. A tape drive member extends inwardly from at least one of the door shafts and is positioned in a spaced and parallel relationship to the shaft. A continuous flexible tape has a portion positioned around the shaft and between the spaced disks. The continuous flexible tape is positioned between the shaft and the tape drive member. Upon rotation, the tape drive member folds the continuous tape around the shaft to increase the counterweight torque applied to the shaft when the effective force generated by the weight of the door is at its greatest.

DESCRIPTION OF THE PREFERRED EMBODIMENT

Figure 1:
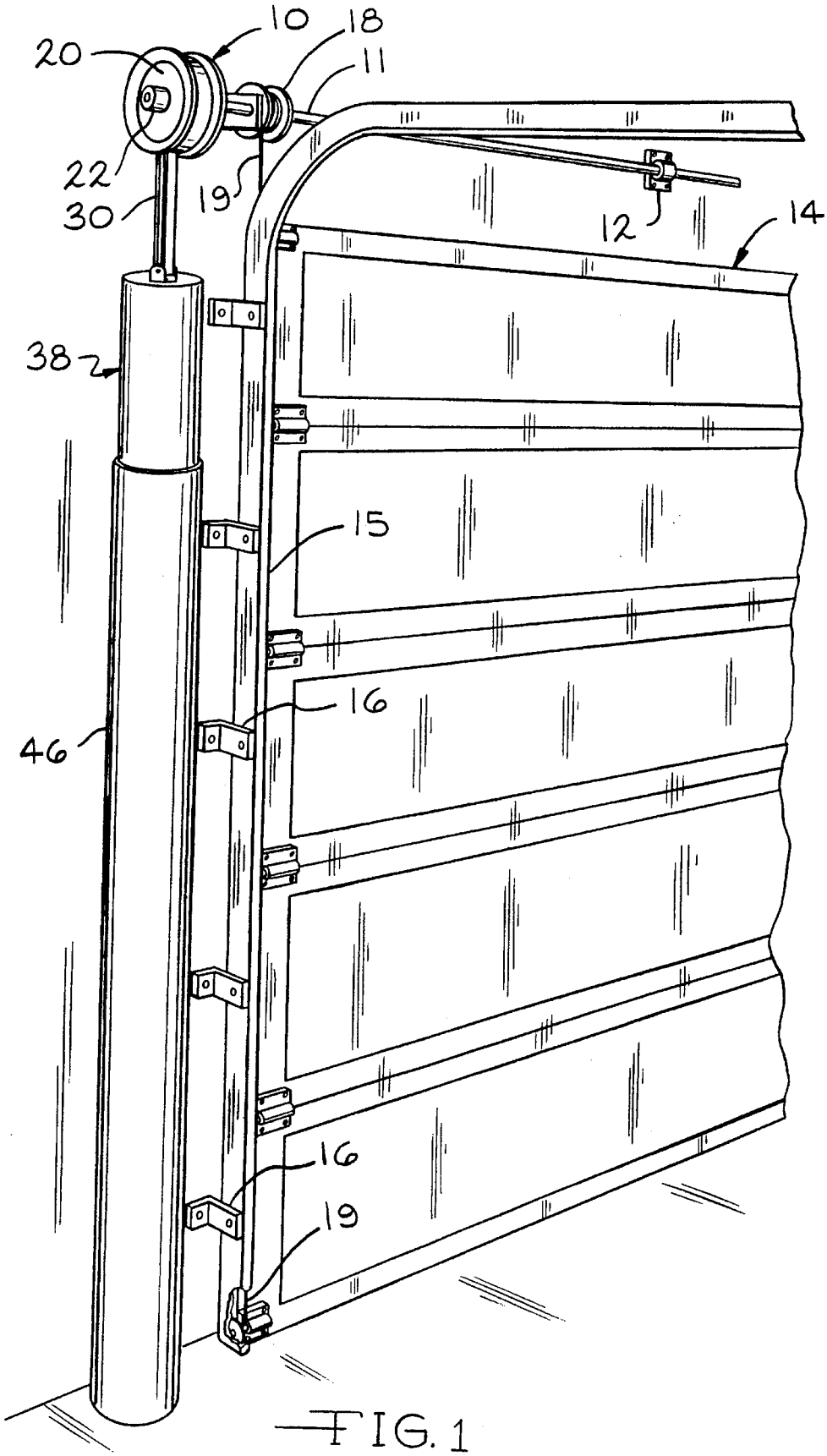
FIG. 1 is a fragmentary perspective view of a door counterweight assembly, according to the present invention, operatively connected to an overhead door.
Figure 2:
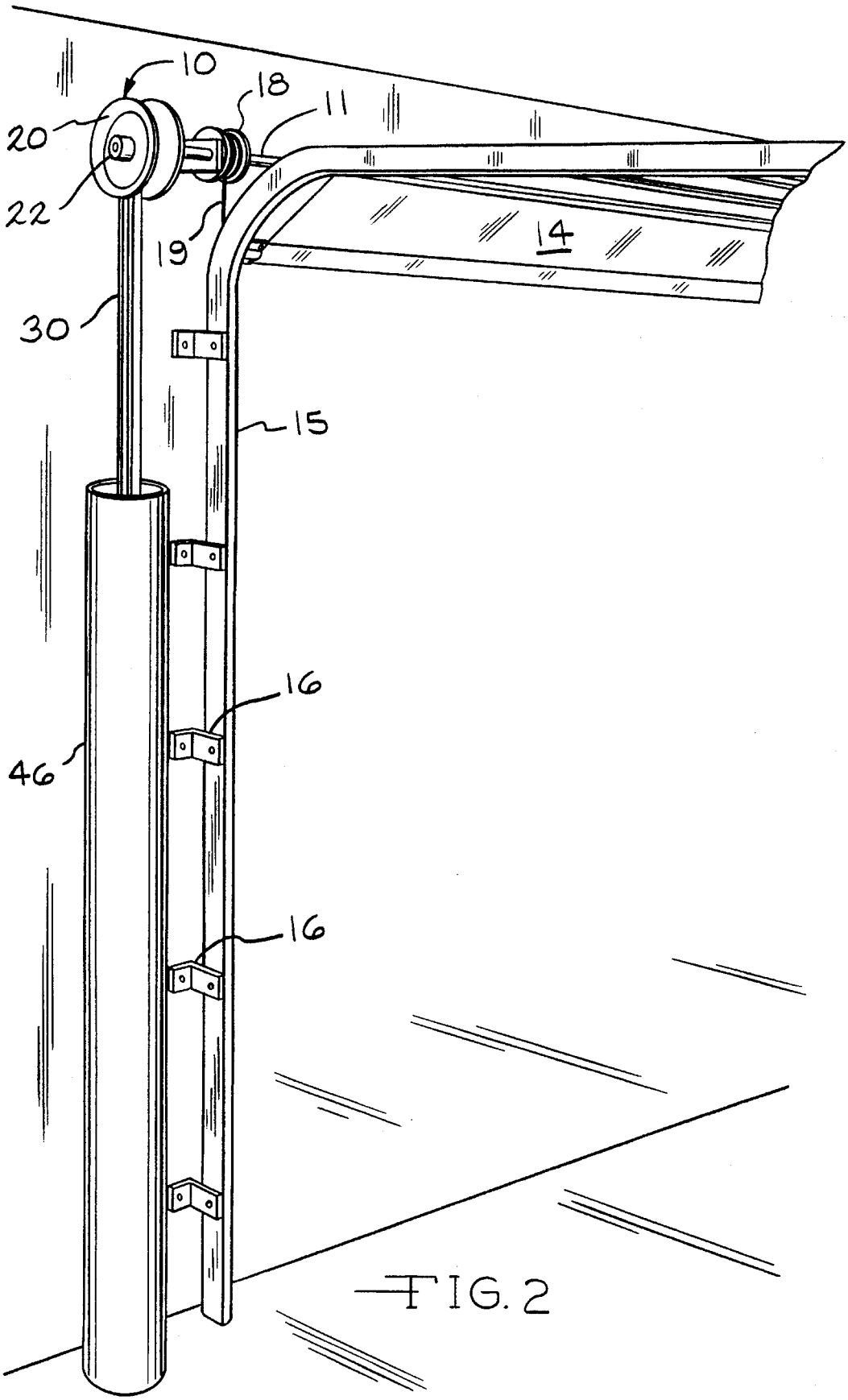
FIG. 2 is a view similar to FIG. 1 with the overhead door shown in an open position.

Referring to FIGS. 1 and 2, a door counterweight assembly, according to the present invention, is generally indicated by the reference number 10. The counterweight assembly 10 is fixably mounted on a door shaft 11. The door shaft 11 is rotatably mounted on a wall by brackets 12. An overhead door 14 is guided by conventional rails 15 which are mounted to the wall by a plurality of angle brackets 16. The overhead door 14 is movable between the generally vertical closed position shown in FIG. 1 and a generally horizontal open position shown in FIG. 2. Other overhead doors (not shown) remain in a vertical position when opened and not moved to a horizontal position. A conventional cable pulley 18 is mounted on the door shaft 11. A cable 19 is carried by the cable pulley 18 and has a lower end which is fixed to the bottom of the overhead door 14, as shown in FIG. 1. When the overhead door 14 is in the closed FIG. 1 position, the weight of the door results in a downward force which is greater than the downward force when the door 14 is in its upper or FIG. 2 position.

It is known in the art that it is desirable that any counterweight apparatus include a provision where the counterweight torque applied to the door shaft 11 is increased when the downward force generated by the weight of the door is at its maximum.

Figure 5:
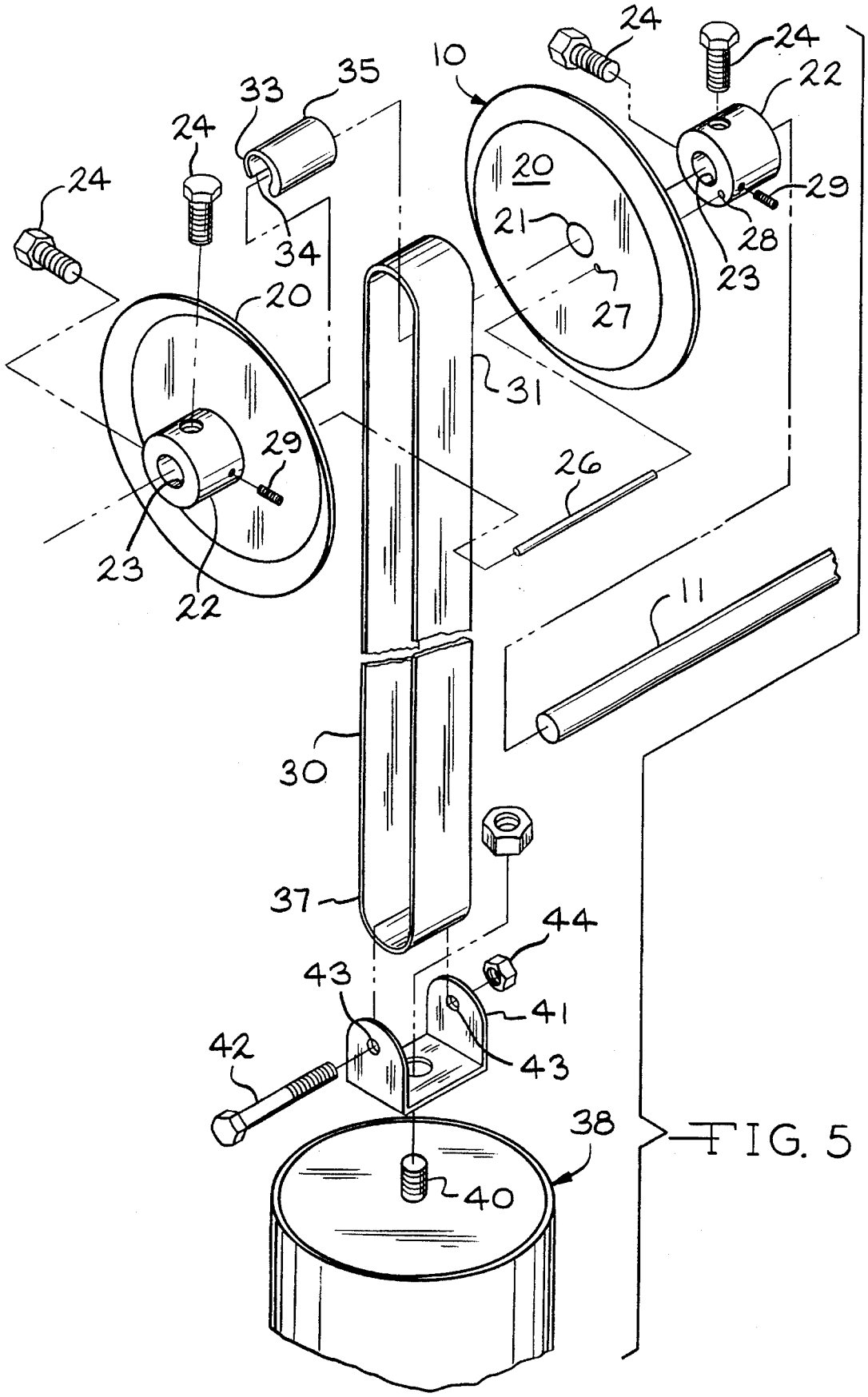
FIG. 5 is a perspective view of the door counterweight assembly, according to the present invention.

Referring to FIG. 5, the door counterweight assembly 10 includes a pair of spaced disks 20 having aligned center openings 21. In the present embodiment, the disks are approximately seven inches (17.75 cm) in diameter. A pair of spaced collars 22 having center openings 23 are mounted on the door shaft 11 adjacent the spaced disks 20. The door shaft 11 is received in the disk openings 21 and the collar openings 23. In the present embodiment, the collars 22 are fixably mounted to the door shaft 11 by screws 24. A tape drive member, for example a drive pin 26, extends through openings 27 in the spaced disks 20 and are threadably engaged in openings 28 in the collars 22. Set screws 29 secure the ends of the drive pin 26 to the spaced collars 22.

Figure 3:
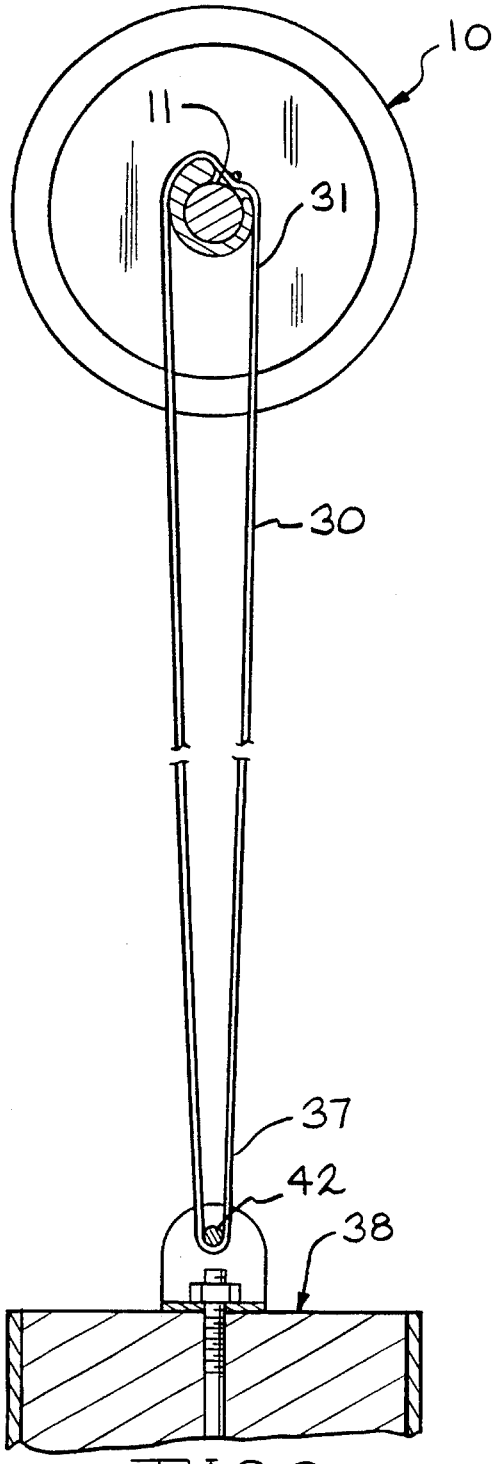
FIG. 3 is a fragmentary cross-sectional view of the door counterweight assembly, according to the present invention, with the counterweight at its lowered position.
Figures 6, 7, 8, 9, 10:
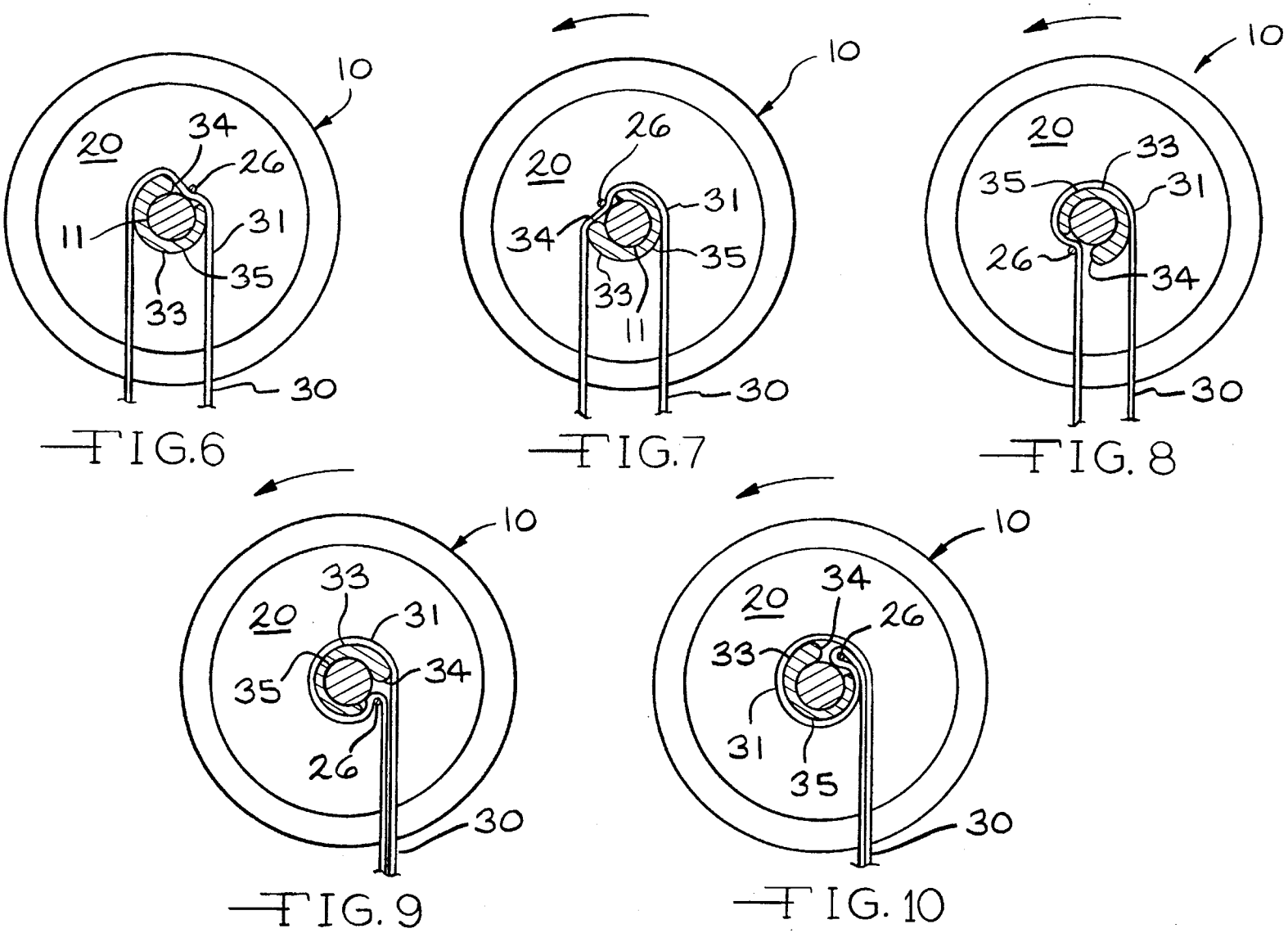
FIG. 6 is a diagrammatic view showing the position of the continuous flexible tape on the door shaft, prior to movement.
FIG. 7 is a view similar to FIG. 6 showing the position of the components after the first rotation of the door shaft.
FIG. 8 is a view similar to FIG. 6 showing the tape drive member as it engages the tape.
FIG. 9 is a view similar to FIG. 6 showing the tape as it is folded in a double layer around the door shaft.
FIG. 10 is a view similar to FIG. 6 showing the next further rotation of the door shaft and the position of the folded tape.

An important feature of the present invention is a continuous flexible tape 30. The tape may be constructed of various materials, including fabrics and metals. However, it is preferably constructed of a strong flexible plastic material such as a nylon material. In the present embodiment, the tape is flat having a width of approximately one inch (2.54 cm) and a thickness of one-eighth inch (0.32 cm). The thickness of the tape varies depending on the required torque. The continuous flexible tape 30 includes a portion 31 which surrounds the door shaft 11, as illustrated in FIG. 3. As illustrated in FIGS. 3 and 6, the drive pin 26 is spaced from and parallel to the door shaft 11 and the tape portion 31 extends between the shaft 11 and the tape drive member 26. As illustrated in FIGS. 6–10, as the door shaft 11 rotates, the drive member 26 begins to fold the flexible tape 31 upon itself. In the present embodiment, a start spacer such as a plastic insert member 33 is mounted on the door shaft 11 between the spaced disks 20. The insert member 33 is generally C shaped defining a longitudinally extending opening 34. The insert member 33 is contoured and includes an outer surface 35. The drive pin 26 is positioned within the insert opening 34. The outer surface 35 of the insert member 33 is spaced from the centerline of said door shaft 11 a distance approximately the same as the outer surface of the drive pin 26 is spaced from the centerline of the door shaft 11. When the tape 30 is folded around the surface 35 of the insert member 33, the surface 35 ensures that the tape is folded so that it is approximately concentric with the shaft 11 and the tape 30 has a generally circular cross section. Because the tape 30 is continuous, as it is folded a double layer of the tape is positioned around the door shaft 11 during each rotation of the door shaft 11. This double folding of the tape is important and ensures that tape quickly moves from the FIG. 3 position to the FIG. 4 position where the tape 30 has a greater effective radius and therefore provides a greater counterweight torque force.

Figure 4:
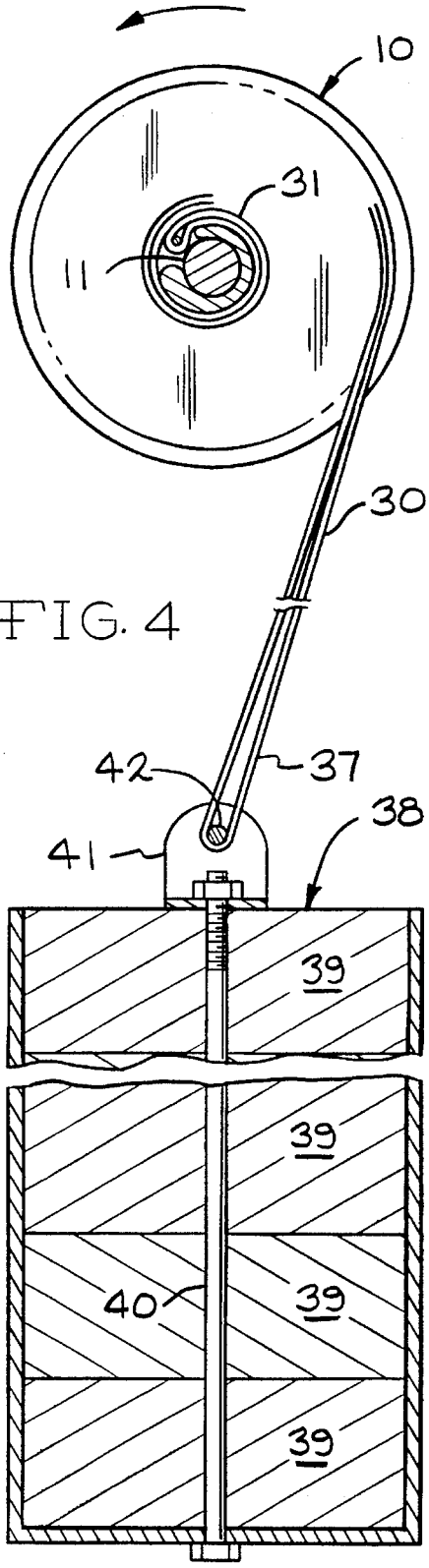
FIG. 4 is a view similar to FIG. 3 with the counterweight at its upper position.

The continuous flexible tape 30 includes a second portion 37 which is connected to a counterweight 38. In the present embodiment, the counterweight 38 comprises a plurality of metal weights 39 which are retained in alignment by a longitudinally extending bolt 40 which is connected to a U-shaped bracket 41 at its upper end. However, the counterweight 38 may be constructed of various materials, including concrete. A bolt 42 extends through aligned holes 43 in the bracket 41 and is secured to the bracket by a nut 44. The bolt 42 serves as a holding bar and receives the lower portion 37 of the tape 30, as illustrated in FIGS. 3 and 4. The tape portion 37 slides on the holding bar 42 as the door counterweight assembly 10 moves between the FIG. 3 and FIG. 4 positions.

As illustrated in FIGS. 1 and 2, the counterweight 38 is preferably mounted within a guide 46. The guide 46 controls swinging movement of the counterweight 38 during operation. In the present embodiment, both the counterweight 38 and the guide 46 are cylindrical in configuration. Other shapes, such as square cross-sections may also be utilized. In the preferred embodiment, the guide 46 is formed from a plastic cylindrical tube.

In a typical operation, the door 14 is initially in the closed position shown in FIG. 1. A lifting force is applied to the door by either a motor drive (not shown) or manually. The lifting force is combined with the counterweight force to overcome the downward force generated by the weight of the door 14. The counterweight 38 is in the raised position and the flexible tape 30 has been folded around the door shaft 11 to provide the greatest radius and therefore the greatest counterweight torque.

As the door 14 moves to the upper open position, the counterweight 38 moves downwardly and the flexible tape 30 unwinds reducing the tape radius as the required counterweight torque force is reduced.

This method of operation is reversed when the door 14 moves from the FIG. 2 open position to the FIG. 1 closed position.

Many revisions may be made to the preferred embodiment of the door counterweight assembly described above without departing from the scope of the present invention or from the following claims.

I claim:

1. A door counterweight assembly for mounting on a shaft, comprising a pair of spaced disks having aligned openings for receiving said shaft, a tape drive member extending inwardly from at least one of said spaced disks, said tape drive member being spaced from and parallel to said shaft and a continuous flexible tape having a portion positioned around said shaft between said spaced disks and another portion attached to a counterweight, said continuous flexible tape being positioned between said shaft and said tape drive member, whereby rotation of said shaft folds said continuous tape around said shaft to increase the counterweight torque applied to said shaft.

2. A door counterweight assembly for mounting on a door shaft, comprising a pair of spaced disks having aligned openings for receiving said door shaft, a pair of spaced collars for mounting on said door shaft adjacent said disks, a continuous, generally flat, flexible tape having a portion positioned around said shaft and between said disks and another portion connected to a counterweight, a tape drive member positioned between said disks in a generally parallel relationship to said door shaft, said flexible tape extending between said shaft and said tape drive member, whereby rotation of said door shaft folds said tape around said shaft to increase the counterweight torque applied to said door shaft.

3. A door counterweight assembly, according to claim 2, including a generally "C" shaped insert member mounted on said door shaft, said insert member having an outer surface spaced from the centerline of said door shaft a distance approximately the same as the tape drive member is spaced from such centerline of said door shaft, whereby when said tape is folded around said shaft, the folded tape has a generally circular cross-section.

4. A door counterweight assembly according to claim 2, wherein said continuous flexible tape is constructed of a plastic material.

5. A door counterweight assembly, according to claim 4, wherein said plastic material is a nylon material.

6. A door counterweight assembly, according to claim 2, wherein said tape drive member comprises a drive pin which extends through said spaced disks, said drive pin having ends mounted to said spaced collars.

7. A door counterweight assembly, according to claim 2, wherein said counterweight includes a holding bar which slidably mounts said continuous flexible tape.

8. A door counterweight assembly, according to claim 2, including a guide adjacent said counterweight.

9. A door counterweight assembly, according to claim 8, wherein said counterweight comprises a plurality of metal cylinders and said guide comprises a cylindrical tube surrounding said metal cylinders.

10. A door counterweight assembly, according to claim 2, including an insert member positioned on said shaft adjacent said tape drive member, said insert member defining an opening on one side which receives the tape drive member.

* * * * *